US005205094A

United States Patent [19]

Holmqvist

[11] Patent Number: 5,205,094

[45] Date of Patent: Apr. 27, 1993

[54] SILO INCLUDING A DEVICE FOR PREVENTING OBSTRUCTION TO AIR FLOW

[75] Inventor: Mats Holmqvist, Lidköping, Sweden

[73] Assignee: PM Luft AB, Kvanum, Sweden

[21] Appl. No.: 802,201

[22] Filed: Dec. 4, 1991

[30] Foreign Application Priority Data

Feb. 26, 1991 [SE] Sweden ..... 9100552

[51] Int. Cl.[5] ..... E04B 1/70

[52] U.S. Cl. ..... 52/197; 52/192; 52/263; 52/588; 52/302.3

[58] Field of Search ..... 52/192, 197, 263, 303, 52/588, 508

[56] References Cited

U.S. PATENT DOCUMENTS

Re. 33,358 10/1990 Sukup ..... 52/192

2,410,338 10/1946 Craine ..... 52/197

*Primary Examiner*—Carl D. Friedman
*Assistant Examiner*—Wynn Wood
*Attorney, Agent, or Firm*—Dennison, Meserole, Pollack & Scheiner

[57] ABSTRACT

A silo for cereals has a sloped bottom including channels provided on their top sides with passages for the flow of air which is used in order to facilitate emptying the silo through an outlet opening. The passages have a tendency to become clogged by dust present in the cereals causing an obstruction to the flow of air. In order to prevent this, the end wall of each channel located in the vicinity of the outlet opening is provided with an opening for the passage of dust while at the same time limiting the amount of air flow through the opening.

2 Claims, 2 Drawing Sheets

SILO INCLUDING A DEVICE FOR PREVENTING OBSTRUCTION TO AIR FLOW

The present invention relates to a silo including means for preventing obstruction of air supply as a result of dust accumulation. More particularly the device pertains to a particular silo having a bottom wall. The silo is intended for use a particular storage container for cereals and is also designed to be emptied when required. A conventional silo has an outlet opening at the bottom and a bottom which is shaped so that cereals lying on the opening bottom will move towards the due to a sloping surface according to the invention, a number of channels are arranged in the bottom, leading from the inner wall and the silo and converging towards its outlet opening. The channels are provided on their upper sides with passages for air. Air is supplied to the end of each channels close to the silo wall. The passages in the channels shall are selected to be so small that cereals are unable to pass through them. When emptying such a silo it is advantageous to supply air to the channels so that the cereals more readily leave the silo. However, a problem arises with such channels since the cereals bring with them a considerable amount of small particles such as dust and these small particles have a tendency to clog the channels so that air cannot pass through them, with the result that it can be difficult to completely empty the silo. If the channels are blocked the remaining cereals must be removed manually through the outlet opening. It is extremely hazardous for people to enter a silo in order to empty it. If the silo is filled with organic products such as cereals and fails to empty, it must be supplied with cooling air and this is done with of the channels for supplying air during emptying.

The object of the present invention is to avoid obstruction by dust particles. Satisfactory operation has been achieved by providing the channel end located nearest to the outlet opening with a transverse wall having an opening or openings preferably located close to the bottom of the channel. Air passing through the opening takes with it the dust particles present in the channel and transports these to the outlet opening. The particles dust can be removed in a later operation. The opening in the channel for the accumulated dust should be as small as possible so that only a minimum amount of air escapes from the channel and does not impede the air flowing out through the upper side passages of the channel.

The present invention will be described in more detail with reference to the accompanying two sheets of drawings, in which FIG. 1 is a fragmentary perspective view of a silo, FIG. 2 is a top plan view illustrating an arrangement of channels at the bottom of the silo.

Figure 1:
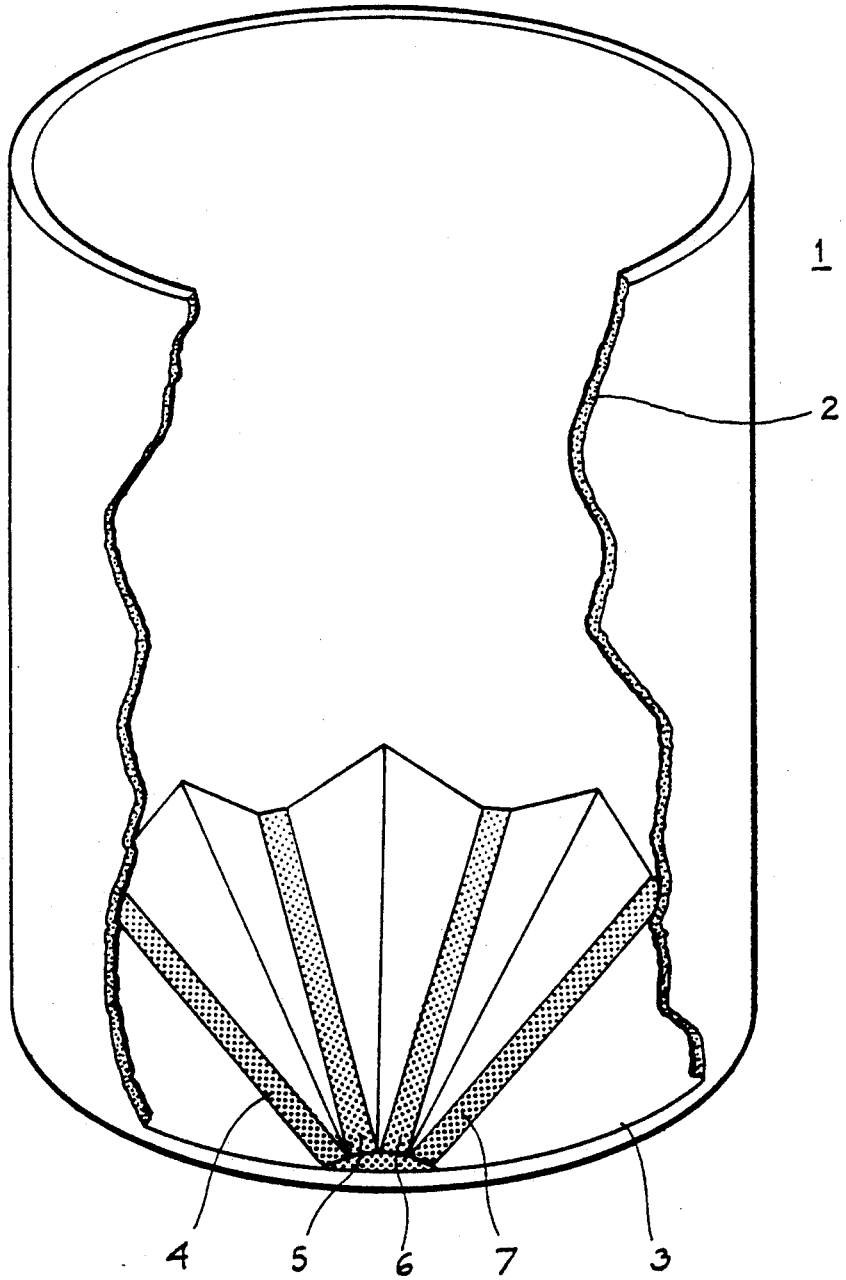
Figure 2:
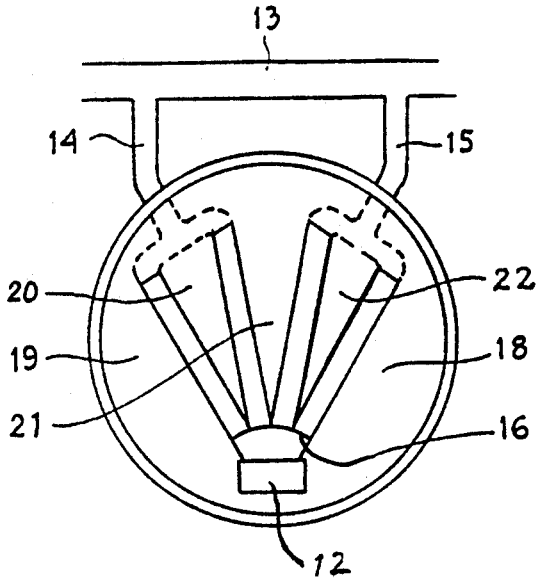
Figure 3:
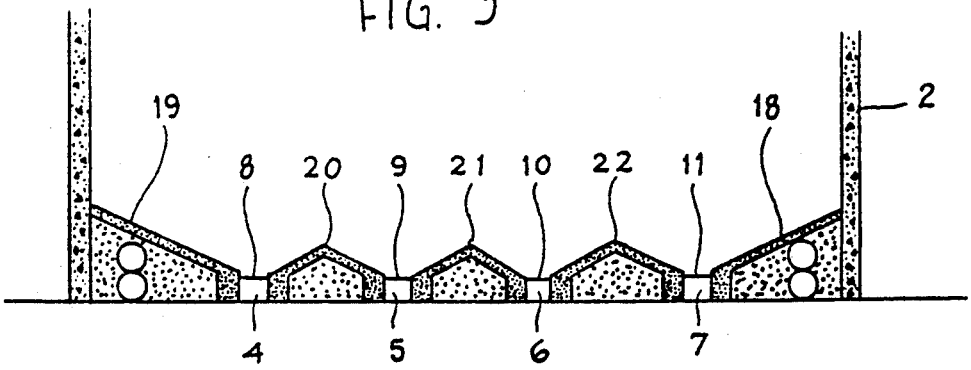
FIG. 3 is a cross section of the bottom of a silo.
Figure 4:
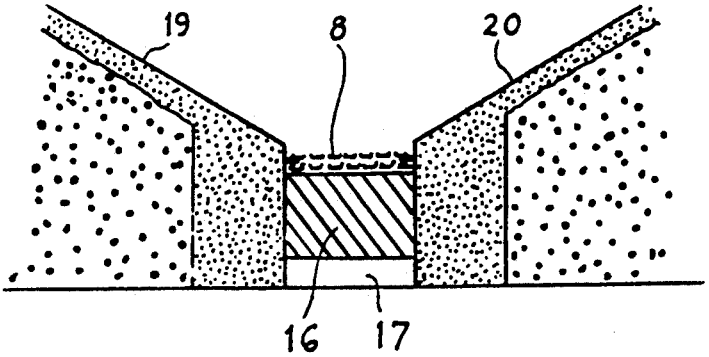
FIG. 4 is a cross-sectional view on an enlarged scale of a channel for air provided with passages on its upper side.

In the drawings is shown a silo with a vertical wall 2 and a sloped bottom 3. The bottom 3 is provided with four channels 4, 5, 6 and 7 which have a rectangular cross section. The upper side of the channels being provided with passages for air. The bottom 3 is arranged to slope towards an outlet opening 12 which means that all surfaces on the bottom 3 slope towards the outlet opening 12. The ends of the channels at the inner wall of the silo are connected to pipes 14 and 15 which in turn communicate with a common pipe 13 through which air is supplied is supplied to facilitate emptying the silo, or cooling air to keep the cereals in the silo intact. The bottom surfaces of the silo are designated 18 to 22 and these surfaces are shown slanted toward a channel in FIGS. 3 and 4. Each channel is provided on its top with are passages, preferably achieved by the upper part of each channel covered by a mesh. FIGS. 3 and 4 show such mesh tops 8 to 11 for the channels 4 to 7. The surfaces 20, 21 and 22 between the channels may be in the nature of ridges, as can be clearly seen in FIG. 3. Due to these ridges the top or upper surface of the channels will form the bottom of flow furrows for the cereal. Each channel is provided at its lower end with a transverse wall 16 with an opening 17 for dust removal. This dust opening is such hat all the dust which collects in a channel is carried to the outlet opening 12 whereas the air passing through the opening 17 is held at a minimum. The opening 17 is thus dimensioned so as to allow only passage of a minimum of air while at the same time sufficient so that all dust is removed from the channel.

The provision of the opening 17 in the channel end wall achieves the advantage of eliminating the need for manual emptying of cereal remnants in a silo, and thereby the advantage that operators do have not to enter the silo in order to completely empty it.

I claim:

1. In a silo for cereals where an air supply is employed for aiding the emptying of the cereals, means or preventing obstruction to the flow of air because of dust particle accumulation, the silo having a vertical side wall (2), a sloping bottom (3), and an outlet opening (12) for the cereals, said means for preventing obstruction to the flow of air comprising:

a plurality of channels (4–7) formed in said sloping bottom, said channels having two ends and being arranged with one of their ends converging toward the outlet opening (12), said air supply (14, 15) connected to the other ends of the channels, each of said channels (4–7) being covered with means having perforations permitting the passage of air but inhibiting the passage of cereals, said means having perforations substantially coinciding with the sloping bottom, and a transverse wall (16) near the outlet opening (12) of each of the channels, said transverse wall (16) having at least one opening (17) sufficiently large to permit dust particles collected in the channels to pass but limiting the air flow to a small quantity.

2. In the silo of claim 1 wherein the sloping bottom surface (3) located between the channels (4–5, 5–6, 6–7) takes the form of a ridge (20, 21, 22) with a surface sloping on each side toward the channels.

* * * * *